US005219080A

United States Patent [19]

Reyes

[11] Patent Number: 5,219,080

[45] Date of Patent: Jun. 15, 1993

[54] CLOTHES DRYING RACK

[76] Inventor: Jose R. L. Reyes, 11444 Avenger Rd., San Diego, Calif. 92126

[21] Appl. No.: 915,313

[22] Filed: Jul. 20, 1992

[51] Int. Cl.[5] ..... A47F 5/00

[52] U.S. Cl. ..... 211/196; 211/204; 211/86

[58] Field of Search ..... 211/189, 204, 205, 196, 211/208, 105.1, 105.3, 86

[56] References Cited

U.S. PATENT DOCUMENTS

| | | | |
|---|---|---|---|
| D. 185,198 | 5/1959 | Gill | D49/1 |
| 2,144,772 | 1/1939 | Plants | 211/123 X |
| 2,594,605 | 4/1952 | Zoppelt | 211/123 |
| 2,823,884 | 2/1958 | Lagerstrom | 248/207 |
| 3,471,031 | 10/1969 | Coplan | 211/86 |
| 4,209,099 | 6/1980 | Wickes | 211/105.3 X |
| 4,790,529 | 12/1988 | Pelle | 272/93 |

OTHER PUBLICATIONS

Fuller Brush Catalog Inc., ©1987 ironing rack item No. 13180A, p. 20.

*Primary Examiner*—Robert W. Gibson, Jr.
*Attorney, Agent, or Firm*—Warren F. B. Lindsley

[57] ABSTRACT

A clothes drying rack for use in a shower stall employing a tubular support formed of two detachably end to end connected tubular parts and having one end engaging the bottom of the shower stall and a pair of arms pivotally connected to the other end of the tubular support and extending laterally therefrom with the free ends of the arms engaging the sides of an associated shower stall. Each of the arms are provided with a plurality of apertures extending in a spaced arrangement along the arm. A plurality of tabs are provided for positioning in the aperture for spacedly maintaining in a controlled position along the arms clothes hangers supported by the arms.

5 Claims, 1 Drawing Sheet

CLOTHES DRYING RACK

BACKGROUND OF THE INVENTION

This invention relates to clothes dryer racks and more particularly to clothes drying racks that are assembled and used in a shower stall, the walls of which aid in maintaining the rack in its extended position.

Clothes drying in apartment buildings usually requires the use of an electric or gas dryer accessible by anyone in the building. In addition to the inconvenience in using it, it is usually not available when desired.

DESCRIPTION OF THE PRIOR ART

U.S. Pat. Des. 185,198 discloses a laundry rack having two arms which are obliquely extended from a vertical support.

U.S. Pat. No. 2,823,884 discloses a clothes drying rack bracket employing three rack arms laterally extending outwardly from a two piece standard.

U.S. Pat. No. 4,790,529 discloses an exercise and training device the ends of the parallel bars being covered with a cushioned cap.

Fuller Brush Catalog Inc. ®1987 ironing rack item No. 13180A, p. 20, merely shows a folding rack having a single arm projecting from a vertical support member with the arm having notches for receiving the hook end of a clothes hanger.

SUMMARY OF THE INVENTION

In accordance with the invention claimed, an improved clothes drying rack is provided which can be readily assembled in a shower stall the walls of which aid in maintaining the rack in its assembled position.

It is, therefore, one object of this invention to provide an improved clothes drying rack.

Another object of this invention is to provide an easily assembled and collapsed clothes drying rack which may be placed in a shower stall the walls of which aid in maintaining the rack in its assembled form.

A further object of this invention is to provide an improved clothes drying rack the arms of which are provided with spacer tabs detachably positioned in apertures spacedly positioned therealong for controlling clothes hangers arranged along its arms.

A still further object of this injention is to provide a simple, economically manufactured clothes drying rack that may be readily assembled by the young as well as the older user in a shower stall and collapsed for storage when the clothes are dried.

A further understanding of the nature and advantages of the present invention will be gained by reference to the following portions of the specifications and the appended drawing.

DESCRIPTION OF THE PREFERRED EMBODIMENT

Figure 1:
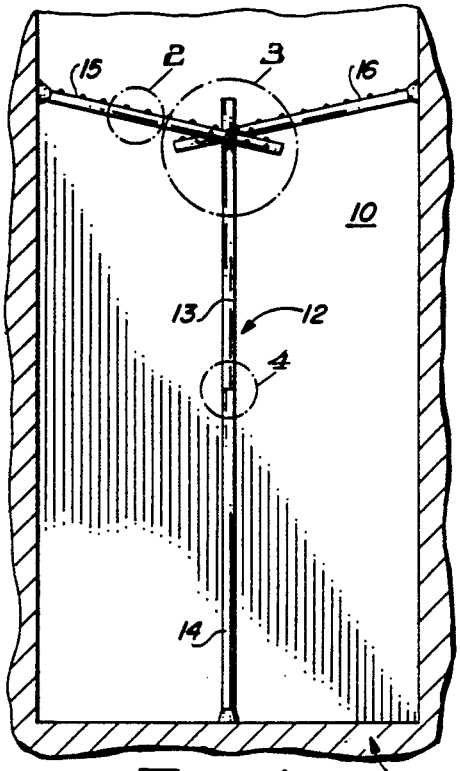
FIG. 1 is a diagrammatic illustration of the clothes drying rack in a shower stall and embodying the invention.

Referring more particularly to the drawing by characters of reference, FIG. 1 discloses a clothes drying rack 10 in its extended clothes drying position in a shower stall 11. The clothes drying rack comprises a hollow tubular support 12 formed in two interconnectable parts 13 and 14 which has a pair of arms 15 and 16 positioned to extend outward of support 12 when in clothes drying use.

Figure 3:
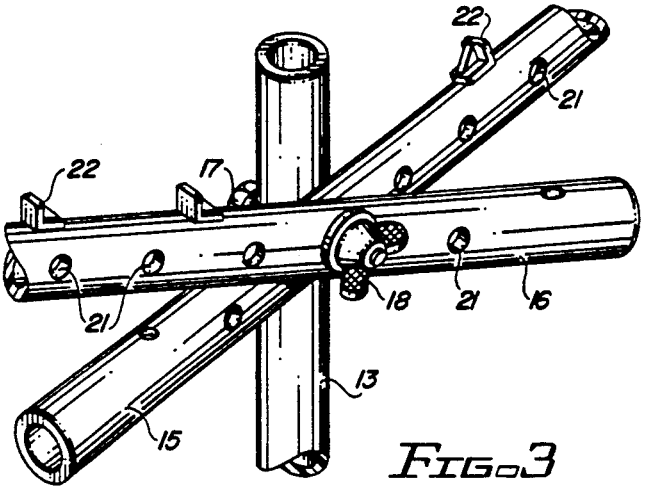
FIG. 3 an enlargement of the circled area of FIG. 1 marked 3.

As shown in FIG. 3, the arms 15 and 16 are interconnected to each other and to support 12 by a pin 17 and wing nut 18 which connection makes it possible to hold the arms in one of a number of angular arrangements with support 12 depending on the spacing of walls 19 and 20 of the shower stall.

Further, each of arms 15 and 16 are provided with a plurality of apertures 21 along their lengths and extending into the hollow interior of the arms which are provided for receiving thereinto in a friction tight arrangement a plurality of tabs 22 one for each aperture.

These tabs are intended to space the hooked ends of hangers (not shown) positioned along the length of the arms and keeping them from sliding toward the pin and nut clamping means especially when the rack is in the angular postion shown in FIG. 1. One or more tabs may be removed to vary the separated lengths for the hooked end of the hangers along the length of the arms.

Figure 4:
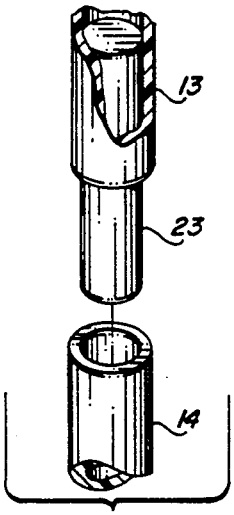
FIG. 4 an enlargement of the circled area of FIG. 4 marked 4.

As shown in FIG. 4, the tubular support 12 comprises a pair of parts 13 and 14 which are interconnected by a rod 23 which is frictionally fitted inside of part 13 and extends outwardly thereof for detachably fitting into the hollow interior of part 14. When parts 13 and 14 are interconnected to form tubular support 12, the juxtapositioned ends of parts 13 and 14 engage each other as shown in FIG. 1.

Figure 5:
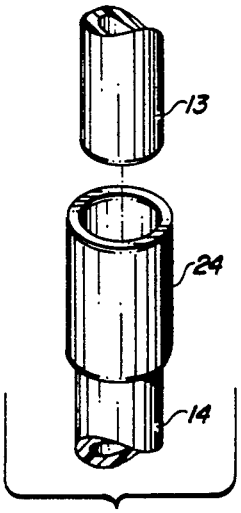
FIG. 5 a modification of the connection shown in FIG. 4.

FIG. 5 illustrates a modification of the connecting means wherein parts 13 and 14 are interconnected by a tubular connector 24 which may be firmly connected to part 14.

Figure 2:
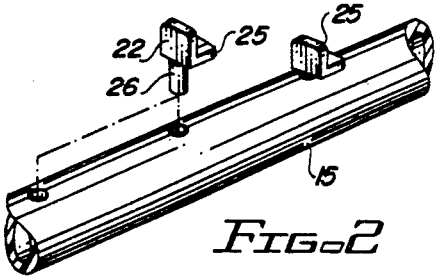
FIG. 2 an enlargement of the circled area marked 2 of FIG. 1 with a tab shown removed from the clothes drying rack.

As shown in FIG. 2, tabs 22 each comprise a right angle member 25 having a tubular extension 26 extending outwardly of the base of member 23 for frictionally fitting into apertures 21.

Figure 6:
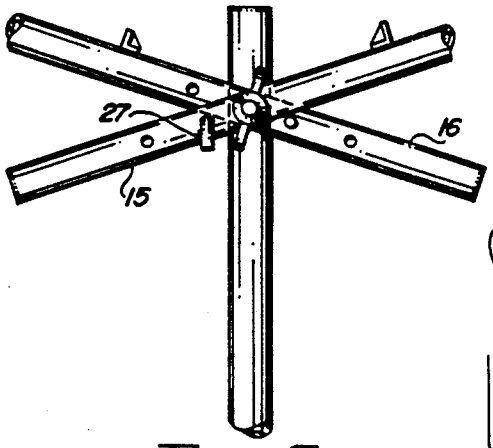
FIG. 6 an enlargement of the area marked 3 of FIG. 1 illustrating a modification thereof.
Figure 7:
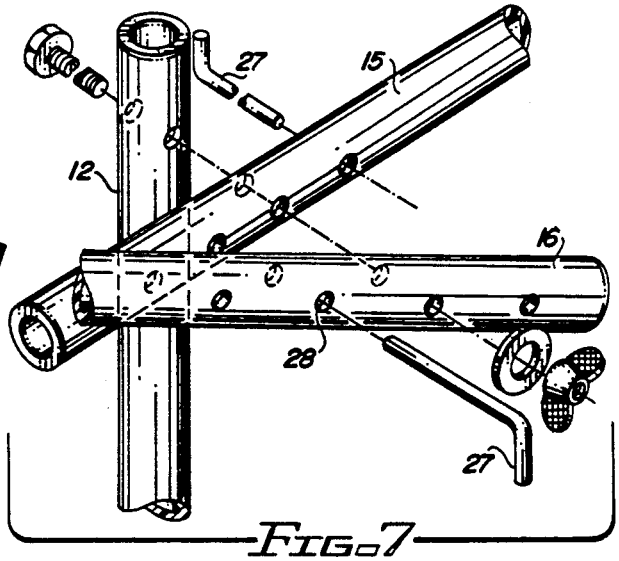
FIG. 7 is a further view of FIG. 6 showing the locking pin of FIG. 6 in an exploded position.

FIGS. 6 and 7 illustrate a modification of the rack shown in FIGS. 1–4 wherein a pin 27 is used for fitting into apertures 28 extending through the associated arm. The use of the additional elongated pin 27 is intended to aid pin 17 and wing nut 18 in supporting arms 15 and 16 under relatively heavy loads of wet clothing.

These pins extend through one arm and underneath the other arm to support it under heavy loads. Although pins 27 are normally not needed, they are provided for heavy loads and also where the user of the rack cannot tighten pin 17 and nut 18 firmly enough.

In order to provide a firm grip with inside walls of the shower stall, the ends of arms 15 and 16 and part 14 are provided with rubber shoes 29 as shown in FIG. 1.

Although but a few embodiments of the present invention have been illustrated and described, it will be apparent to those skilled in the art that various changes and modifications may be made therein without departing from the spirit of the invention or from the scope of the appended claims.

What is claimed is:

1. A collapsible and extendable clothes drying rack for use in a shower stall comprising:

a vertically extending tubular support comprising two parts selectively interconnectable in an end to end arrangement, one of said interconnectable parts having a rubber shoe mounted thereon for engaging the bottom of said stall, the free end of the other of said interconnectable parts having a pair of arms pivotally attached thereto in one of a number of positions, each of said arms having a plurality of spaced apertures extending in a straight line along the length thereof, a plurality of tabs for positioning in and frictionally engaging the sides of said apertures for providing a confining space along said arms for mounting clothes hangers, and a resilient shoe for mounting around the free end of each of said arms for holding the rack in a vertical position in the shower stall.

2. The clothes drying rack set forth in claim 1 wherein said apertures are equally spaced along each of said arms.

3. The clothes drying rack set forth in claim 1 wherein each of said tabs comprises a right angle base having a tubular member extending laterally from said base for penetrating a different one of said apertures.

4. The clothes drying rack set forth in claim 1 in further combination with:

an elongated pin for extending through one of said arms and underneath the other of said arms for aiding in supporting said arms in their extended positions.

5. The clothes drying rack set forth in claim 4 wherein a pair of elongated pins are provided each extending through a different one of said arms and extending under the other of said arms for locking said rack in its extended position.

* * * * *